US012116852B2

(12) United States Patent
Khan

(10) Patent No.: US 12,116,852 B2
(45) Date of Patent: Oct. 15, 2024

(54) OPEN HOLE TIEBACK COMPLETION PRESSURE ACTIVATED BACKPRESSURE VALVE, SYSTEM, AND METHOD

(71) Applicant: Mohammed Parvez Khan, Dhahran (SA)

(72) Inventor: Mohammed Parvez Khan, Dhahran (SA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/837,363

(22) Filed: Jun. 10, 2022

(65) Prior Publication Data

US 2023/0399905 A1 Dec. 14, 2023

(51) Int. Cl.
*E21B 23/02* (2006.01)
*E21B 34/14* (2006.01)

(52) U.S. Cl.
CPC ..... *E21B 23/02* (2013.01); *E21B 34/14* (2013.01)

(58) Field of Classification Search
CPC ..... E21B 34/14; E21B 2200/05; E21B 23/02
See application file for complete search history.

(56) References Cited

U.S. PATENT DOCUMENTS

2014/0048333 A1* 2/2014 Fears ..... E21B 7/18 175/57
2014/0251609 A1 9/2014 Broussard et al.
2016/0032685 A1 2/2016 Roane et al.
2016/0341002 A1* 11/2016 McKitrick, III ..... E21B 34/14
2018/0238139 A1* 8/2018 Gao ..... E21B 33/14
2018/0306003 A1 10/2018 Purkis et al.
2019/0040715 A1 2/2019 Provost
2019/0178052 A1* 6/2019 Giroux ..... E21B 34/14
2021/0372229 A1 12/2021 Palmer et al.
2022/0049576 A1* 2/2022 Parameshwaraiah ... E21B 17/14

OTHER PUBLICATIONS

Notification of Transmittal of the International Search Report and the Written Opinion of the International Searching Authority, or the Declaration; PCT/US2023/024962; Mail date: Sep. 19, 2023: 11 pages.
Baker Hughes, "E Hydro-Trip Pressure Sub"; Aug. 9, 2020; 11 pages.

* cited by examiner

*Primary Examiner* — Dany E Akakpo
(74) *Attorney, Agent, or Firm* — CANTOR COLBURN LLP

(57) ABSTRACT

An open hole tieback completion pressure activated backpressure valve including a housing, a flapper articulated to the housing, a lock out sleeve axially movably disposed within the housing and operatively disposed in relation to the flapper, a seat operatively connected to the sleeve, and a profile that locks the sleeve in place after axial movement of the sleeve. A borehole system including an intervention-less closed lower completion system having delayed opening activation valves with a wellbore isolation valve uphole of a float shoe, and a casing tie-back completion including the valve. A method for completing an open hole including landing an object on a seat of an open hole tieback completion pressure activated backpressure valve, locking out the valve, releasing the object, and landing the same object on a well isolation valve of a lower completion.

10 Claims, 9 Drawing Sheets

OPEN HOLE TIEBACK COMPLETION PRESSURE ACTIVATED BACKPRESSURE VALVE, SYSTEM, AND METHOD

BACKGROUND

In the resource recovery industry and fluid sequestration industry boreholes are drilled in subsurface formations to access reserves that are deposited in the formations. Often it is necessary to install completions to control flow and solids production. Completions installations are often time consuming and costly endeavors and require precision in installation. The art will sell appreciate alternatives that reduce time and or cost.

SUMMARY

An embodiment of an open hole tieback completion pressure activated backpressure valve including a housing, a flapper articulated to the housing, a lock out sleeve axially movably disposed within the housing and operatively disposed in relation to the flapper, a seat operatively connected to the sleeve, and a profile that locks the sleeve in place after axial movement of the sleeve.

An embodiment of a borehole system including an intervention-less closed lower completion system having delayed opening activation valves with a wellbore isolation valve uphole of a float shoe, and a casing tie-back completion including the valve.

An embodiment of a method for completing an open hole including landing an object on a seat of an open hole tieback completion pressure activated backpressure valve, locking out the valve, releasing the object, and landing the same object on a well isolation valve of a lower completion.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
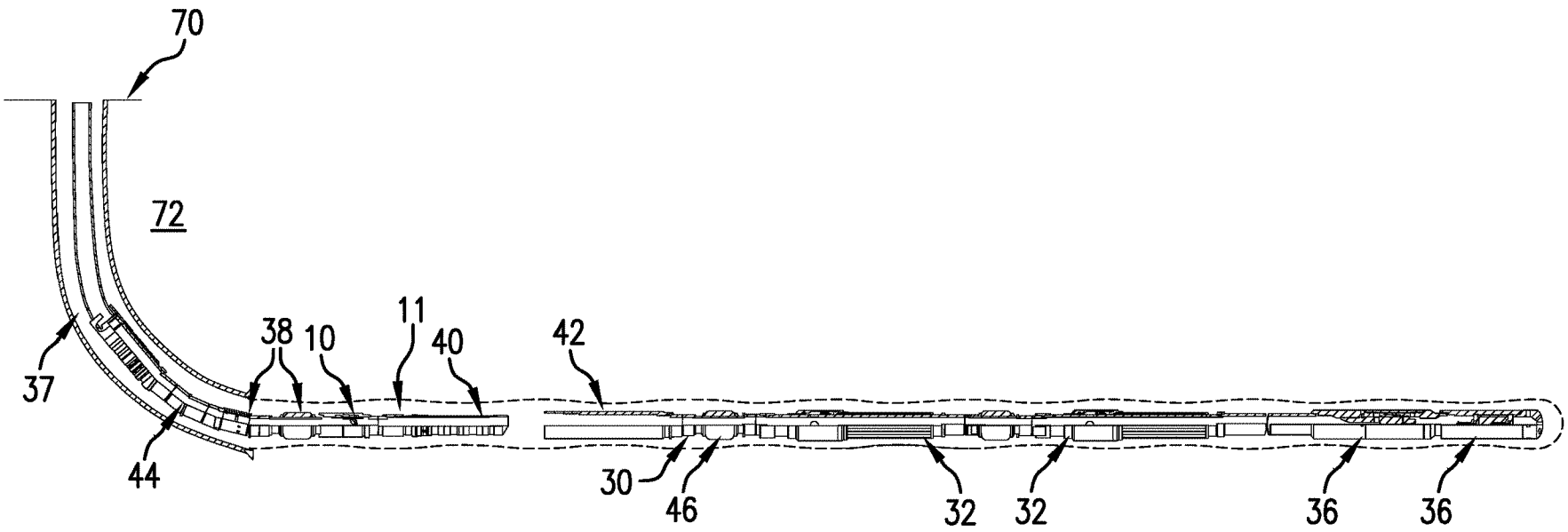
FIG. 1 is a schematic sectional view of system including an open hole tieback completion pressure activated backpressure valve as disclosed herein prior to connection.
Figure 2:
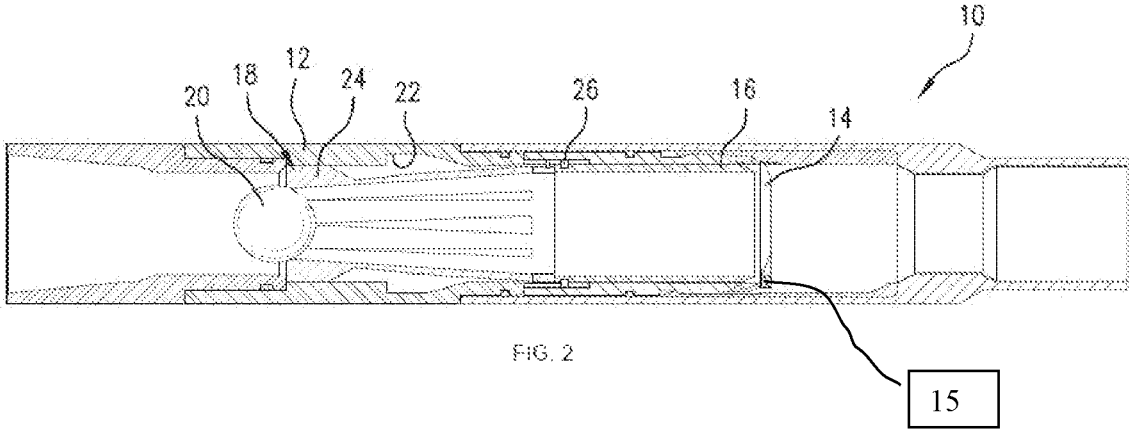
FIG. 2 is a cross sectional enlarged view of the open hole tieback completion pressure activated backpressure valve in a valve closed position.
Figure 3:
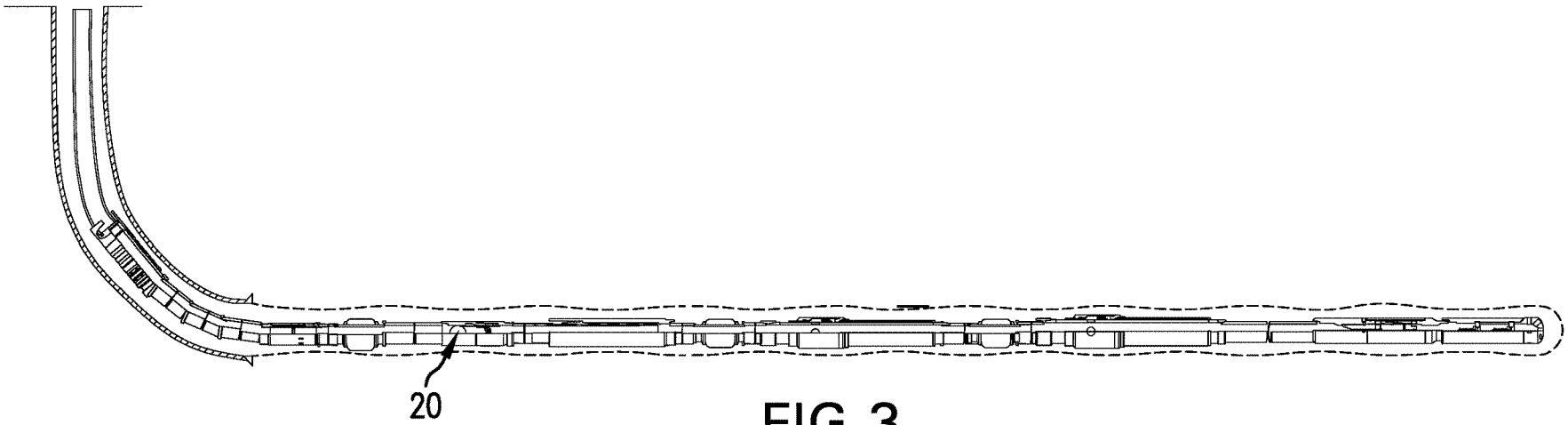
FIG. 3 is a schematic sectional view of the system of FIG. 1 including the open hole tieback completion pressure activated backpressure valve as disclosed herein after connection of the first and second stages.
Figure 4:
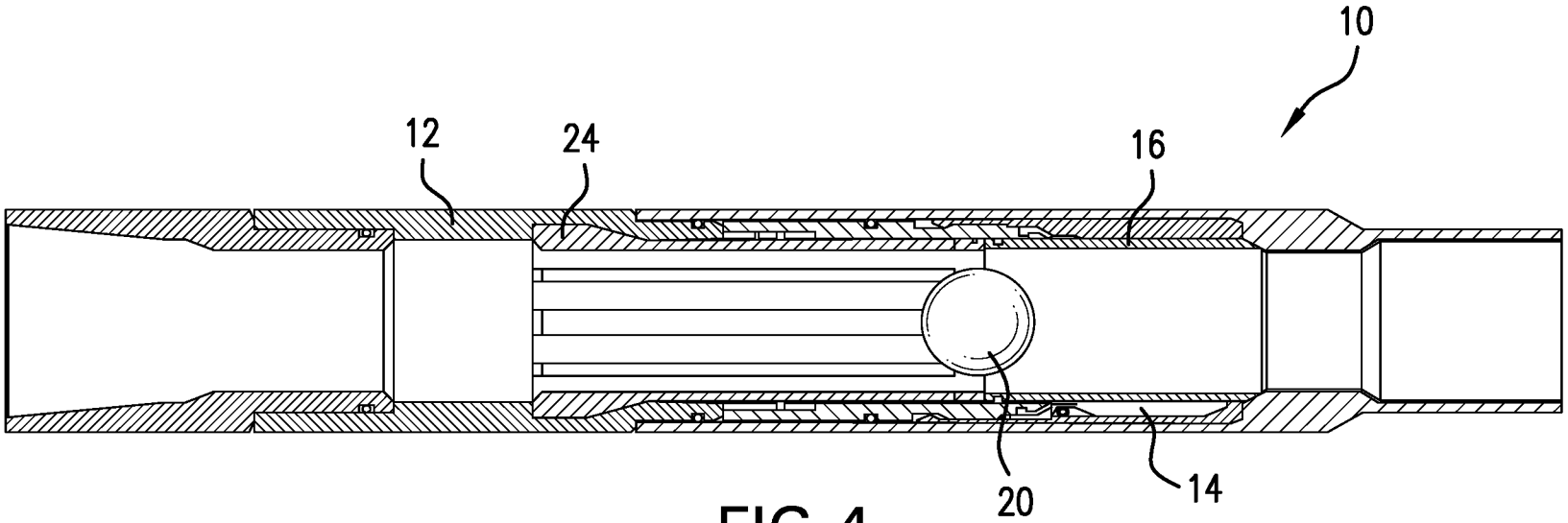
FIG. 4 is the valve of FIG. 2 in an open position.
Figure 5:
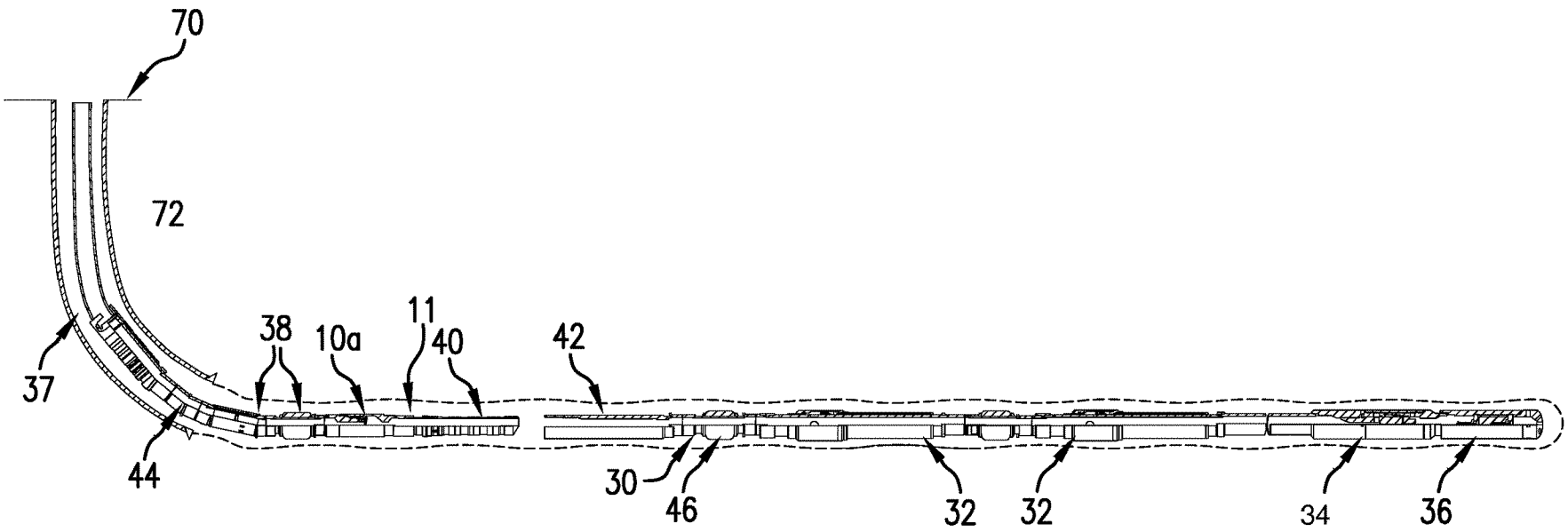
FIG. 5 is a schematic sectional view of a system including an alternate open hole tieback completion pressure activated backpressure valve as disclosed herein prior to connection.
Figure 6:
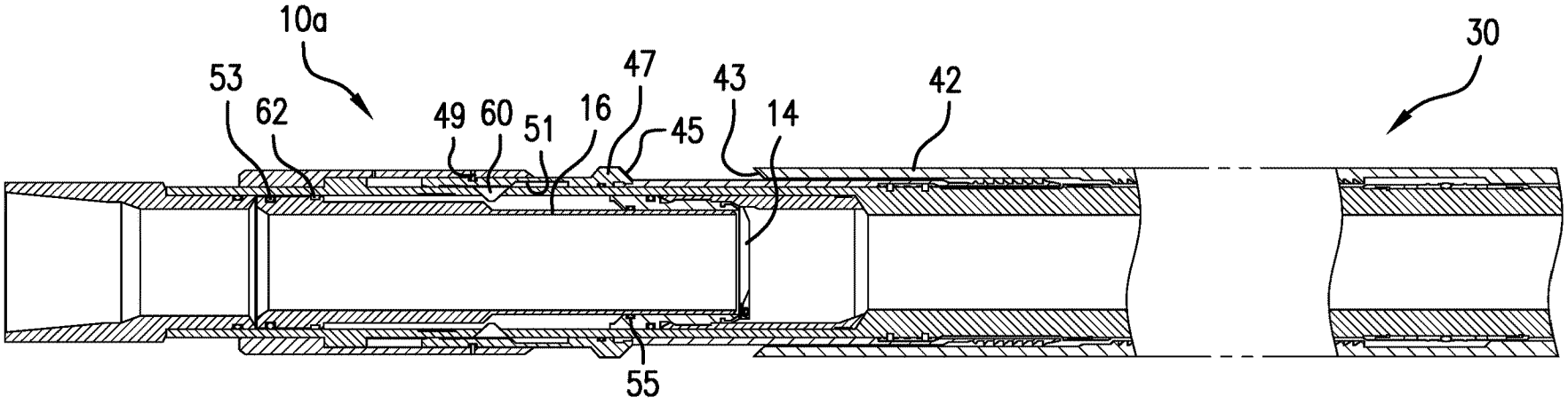
FIG. 6 is an alternate embodiment of a backpressure valve as disclosed herein in a closed position.
Figure 7:
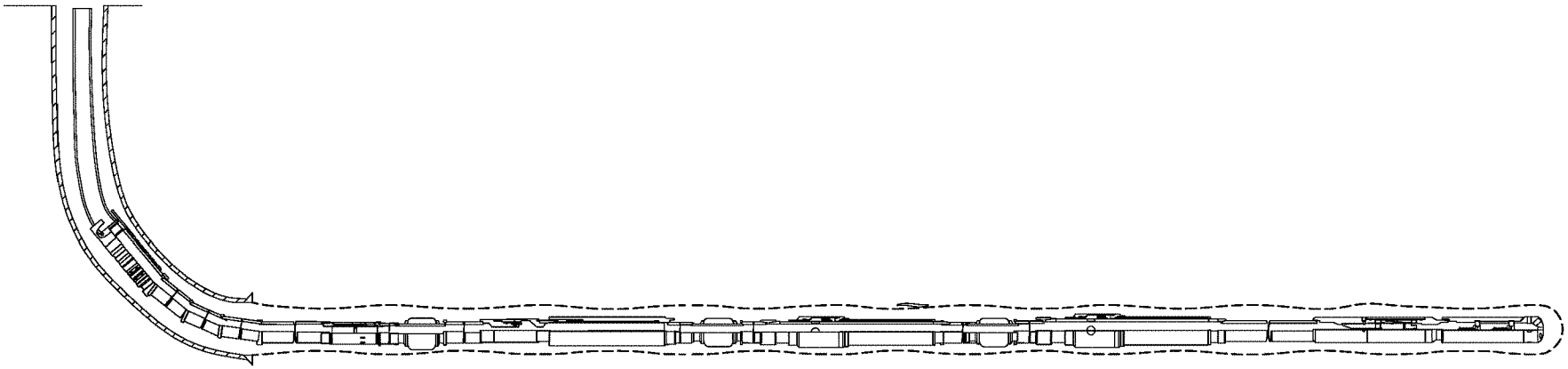
FIG. 7 is a schematic sectional view of the system of FIG. 5 including the open hole tieback completion pressure activated backpressure valve as disclosed herein after connection of the first and second stages
Figure 8:
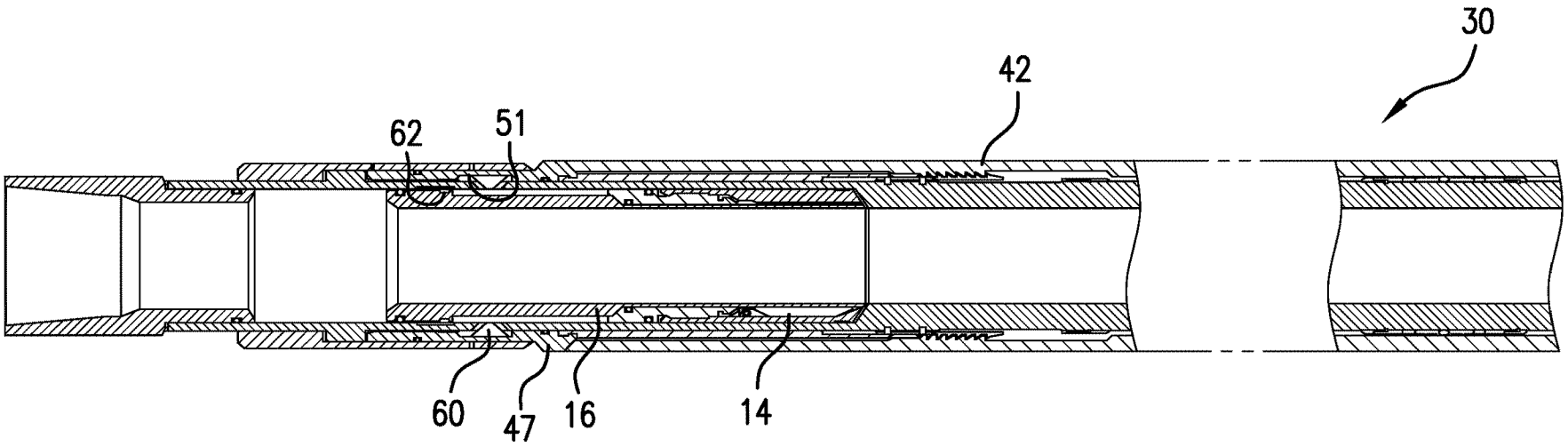
FIG. 8 is the backpressure valve illustrated in FIG. 3 but in an open position.

A detailed description of one or more embodiments of the disclosed apparatus and method are presented herein by way of exemplification and not limitation with reference to the Figures.

Referring to FIGS. 1-4, an open hole tieback (e.g. casing) completion pressure activated backpressure valve 10 is illustrated in cross section. The valve 10 is in use a part of the second stage of a two-stage completion 11 (this may be a two-stage lower completion or lower completion and an upper completion), the valve 10 comprising a housing 12, a flapper 14 articulated to a pin 15 that is fixed to the housing 12, a lockout sleeve 16 disposed in the housing 12 and axially movable relative to the housing 12 such that the sleeve 16 is movable to a valve operable position in which the flapper 14 is free to move between open and closed conditions and a locked position in which the flapper 14 is locked open due to the sleeve 16 being located to act as a physical impediment to the closure of the flapper 14. A seat 18 is disposed within the housing 12 and is in operable communication with the sleeve 16 such that manipulation of the seat 18 through an object 20 landed thereon will cause movement of the sleeve 16 from the valve operable position to the locked position in which the flapper 14 is locked open. In the locked position, it is also contemplated and illustrated that the sleeve 16 be permanently retained in this position once the locked open position has been attained. In an embodiment, as illustrated, a retention configuration is provided by an interaction between a profile 22 in the housing, which may be a recess or other geometric shape that would, when engaged with a complementary shape, prevent or restrict relative movement between the profile 22, and the housing 12.

The seat 18 in an embodiment is configured by deflecting a number of collet fingers 24 radially inwardly against a surface of the housing 12. In this deflected position, the collet fingers come together to form the seat 18. The seat 18 is then receptive to the object 20, which may be a tripping ball, a dart, a plug, etc. that may be conveyed to the seat 18 from a remote location including a surface location and landed thereon. Once the object 20 is landed on seat 18, fluid flow through the seat 18 during use would be stopped and pressure is buildable on the object 20. At a threshold pressure that is preselected by a release threshold for a release member 26, that may be a shear screw, another collet, a snap ring, etc., the seat 18 and anything attached thereto, such as the sleeve 16, will shift in a downstream direction. Shifting of the sleeve 16 results in the flapper 14 opening and shifting of the seat 18 to a position illustrated in FIG. 2 allows the collet fingers 24 to spring open into profile 22, thereby permanently locking the flapper 14 in the open position. It should be noted that the valve 10 allows pumping through of fluid from uphole to downhole at all times and only allows fluid to move in the uphole direction after the sleeve 16 has been shifted to lock open the flapper 14.

In use, and referring collectively to all of the figures, the valve 10 enhances completion of open holes and improves the method of doing so. Valve 10 facilitates an intervention-less closed lower completion system 30 with delayed opening activation valves 32 (for example, in inflow control devices of the lower completion) with a wellbore isolation valve 34 above a float shoe 36. In a first trip, the lower completion 30 can be landed at setting depth in a borehole 37. In a second trip, a cemented off-bottom assembly 38 can be deployed, by a conveyance such as a work string or similar, with the pressure activated back-pressure valve 10 above a tieback seal assembly 40. The second trip can be deployed just as a standard liner with the valve 10 doing the work traditionally done by liner floats. Once the seal assembly 40 is engaged in a setting sleeve 42 of the lower completion 30, breaker fluid may be displaced around the lower completion 30. This operation is more efficient using the combination of components identified since the lower completion 30 utilizes delayed opening valves 32. The displacement fluid is chased with object 20, which as described, locks the back-pressure valve 10 in the open position. The same object 20 is released by valve 10 and proceeds by pumping or gravity or both to the wellbore isolation valve 34 at the bottom of the lower completion 30. This closes the valve 34 with the same object used to lock open valve 10 resulting in a closed tubing string 44. Internal tubing pressure may be raised to set or actuate all tools in the string 44 such as open hole packers 46, delayed opening valves 32, off-bottom cemented annular isolation packers, cementing valve(s), etc. In this condition, a common cement job may be performed, followed by a common cement clean-out trip.

The valve 10 and method set forth provide reduced rig time and reduced cost through a number of efficiencies. The method eliminates one full dedicated wash-pipe trip to displace the filter cake breaker fluid and set open hole packers relative to prior art methods. Further, no inflation/packer setting tool is required and no float equipment must be drilled out saving additional time and expense. Finally, the valve 10 and method disclosed reduces risk of hole collapse on screens of the completion since the displacement of the breaker fluid is undertaken immediately after the tieback seals 40 are installed in the lower completion setting sleeve 42.

In another embodiment of valve 10 designated 10*a*, referring to FIGS. 5-8, the valve 10*a* is modified with a mechanical trigger of the valve by employing a locking dog 60 instead of the collet fingers 24. This is shiftable from its initial position in FIGS. 5 and 6 to its locked open position in FIGS. 7 and 8 where the sleeve 16 again holds flapper 14 open. Once again, the seal assembly 40 is engaged in the setting sleeve 42. Weight will shoulder between setting shoulder 43 and set down shoulder 45 of locator 47. At this point further slacking of weight will load locator 47. Upon a preselected load rating on locator 47, a release member 49 (which in some embodiments may be a shear screw or other equivalent structures for controlled release at a threshold load) will release. Upon release, the locator 47 moves between the position illustrated in FIG. 6 and that in FIG. 8. It will be appreciated that locator 47 includes a groove 51 therein that is repositioned to radially outwardly of the dog 60, thereby allowing dog 60 to move radially outwardly. Once the dog 60 moves radially outwardly into the groove 51 within locator 47, the sleeve 16 is permitted to move axially under the impetus of applied tubing pressure. Tubing pressure has this effect because the sleeve 16 includes a seal 53 and a seal 55 that are of differing seal areas and hence there is a differential force acting across the sleeve 16. Axial movement of sleeve 16 pushes the flapper 14 again into a permanently locked open position. A lock 62 such as a c-ring or similar, retains the sleeve 16 in the shifted flapper open position and permanently locks the sleeve 16 and hence the valve 10*a* in the open position.

Figure 9:
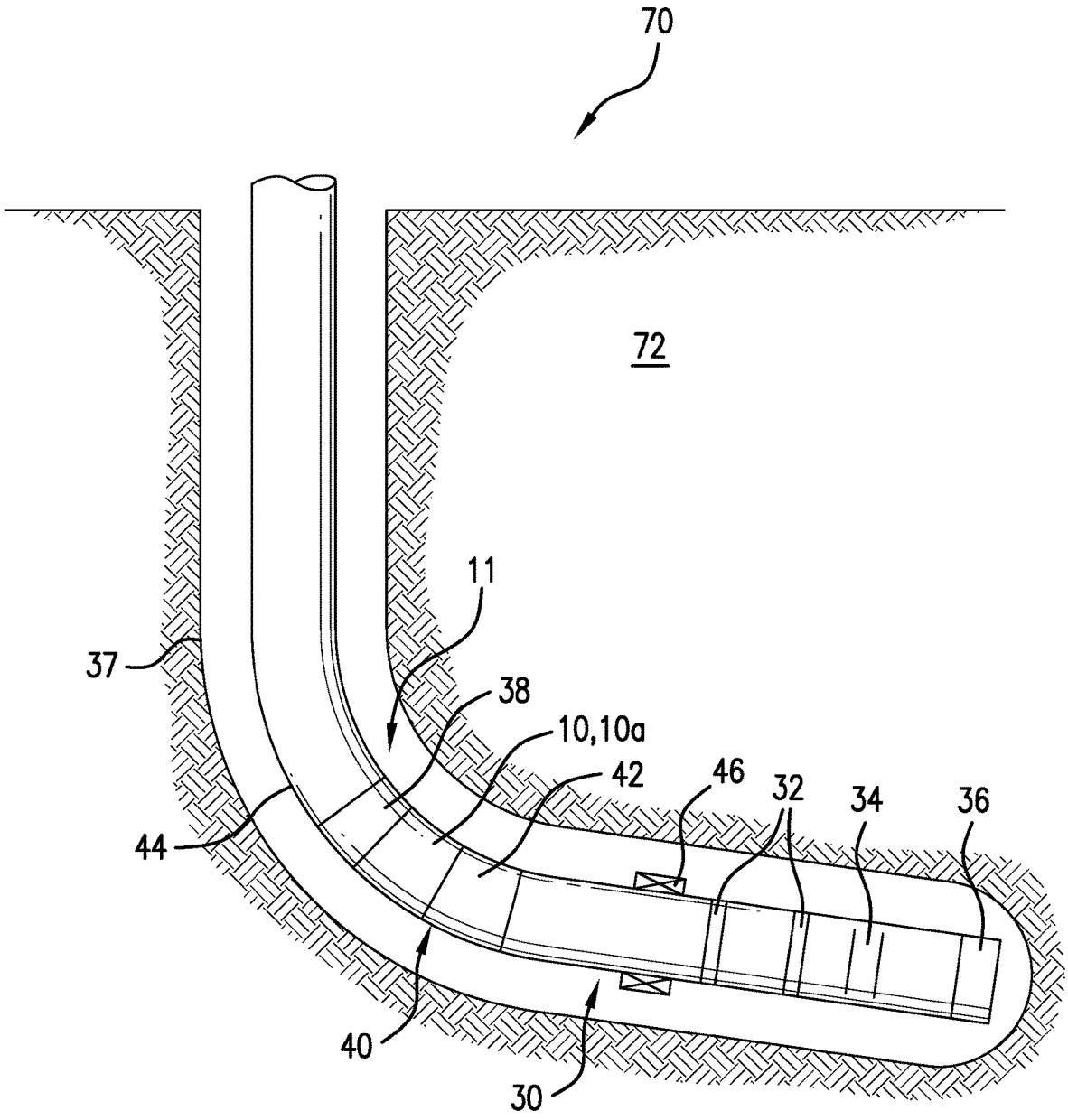
FIG. 9 is a view of a borehole system with a two stage completion and including the valve as disclosed herein.

Referring to FIG. 9, a borehole system 70 illustrated. The system 70 comprises the borehole 37 in a subsurface formation 72. The string 44 is disposed within the borehole 37 and comprises 2 stages, with second stage 11 stabbed into the first stage 30. Stage 2 includes the valve 10 or 10*a*.

Set forth below are some embodiments of the foregoing disclosure:

Embodiment 1: An open hole tieback completion pressure activated backpressure valve including a housing, a flapper articulated to the housing, a lock out sleeve axially movably disposed within the housing and operatively disposed in relation to the flapper, a seat operatively connected to the sleeve, and a profile that locks the sleeve in place after axial movement of the sleeve.

Embodiment 2: The valve as in any prior embodiment wherein the seat is both interactive with a plug landable thereon and engagable with the profile to lock the sleeve in place.

Embodiment 3: The valve as in any prior embodiment wherein the seat is a collet.

Embodiment 4: The valve as in any prior embodiment further comprising a dog.

Embodiment 5: The valve as in any prior embodiment wherein the collet is forced to a shape in which it is receptive to seating the plug by the housing and engages the profile in an unbiased condition.

Embodiment 6: The valve as in any prior embodiment wherein the sleeve is initially retained in place by a release member.

Embodiment 7: The valve as in any prior embodiment wherein the release member is a shear screw.

Embodiment 8: The valve as in any prior embodiment wherein the profile is a recess.

Embodiment 9: A casing tie-back completion including a conveyance, and a valve as in any prior embodiment connected to the conveyance.

Embodiment 10: The completion as in any prior embodiment wherein the conveyance is a tubing string.

Embodiment 11: A borehole system including an intervention-less closed lower completion system having delayed opening activation valves with a wellbore isolation valve uphole of a float shoe, and a casing tie-back completion including the valve as in any prior embodiment.

Embodiment 12: A method for completing an open hole including landing an object on a seat of an open hole tieback completion pressure activated backpressure valve, locking out the valve, releasing the object, and landing the same object on a well isolation valve of a lower completion.

Embodiment 13: The method as in any prior embodiment further including setting tools in the lower completion using hydraulic pressure.

Embodiment 14: The method as in any prior embodiment further including deploying lower completion in 2 stages.

Embodiment 15: The method as in any prior embodiment wherein locking out includes pressuring on the object to release a release member and stroking the seat to cause a physical obstruction to closure of the valve.

Embodiment 16: The method as in any prior embodiment wherein the releasing occurs automatically upon lockout of the valve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An open hole tieback completion pressure activated backpressure valve comprising:

a housing;

a flapper articulated to a pin;

a lock out sleeve having a collet thereon, the collet configurable to produce a seat to catch an object, the sleeve axially movably disposed within the housing in response to fluid pressure against the object landed on the seat when in use, the sleeve positioned to allow the flapper to be closed before axial movement of the sleeve and positioned to impede closure of the flapper after axial movement the sleeve;

and a profile that locks the sleeve in place after the axial movement of the sleeve.

2. The valve as claimed in claim 1 wherein the seat is both interactive with a plug landable thereon and engagable with the profile to lock the sleeve in place.

3. The valve as claimed in claim 1 further comprising a dog.

4. The valve as claimed in claim 1 wherein the collet is forced to a shape in which it is receptive to seating the plug by the housing and engages the profile in an unbiased condition.

5. The valve as claimed in claim 1 wherein the sleeve is initially retained in place by a release member.

6. The valve as claimed in claim 5 wherein the release member is a shear screw.

7. The valve as claimed in claim 1 wherein the profile is a recess.

8. A casing tie-back completion comprising:

a conveyance; and a valve as claimed in claim 1 connected to the conveyance.

9. The completion as claimed in claim 8 wherein the conveyance is a tubing string.

10. A borehole system comprising:

an intervention-less closed lower completion system having delayed opening activation valves with a wellbore isolation valve uphole of a float shoe; and a casing tie-back completion including a valve as claimed in claim 1.

* * * * *